US008615903B2

(12) United States Patent
Zona

(10) Patent No.: US 8,615,903 B2
(45) Date of Patent: Dec. 31, 2013

(54) SUPPORT LINERS AND ARRANGEMENTS INCLUDING THE SAME

(75) Inventor: James E. Zona, Fox Chapel, PA (US)

(73) Assignee: Pittsburgh Plastics Manufacturing Inc., Butler, PA (US)

( * ) Notice: Subject to any disclaimer, the term of this patent is extended or adjusted under 35 U.S.C. 154(b) by 488 days.

(21) Appl. No.: 12/984,316

(22) Filed: Jan. 4, 2011

(65) Prior Publication Data

US 2011/0094124 A1 Apr. 28, 2011

Related U.S. Application Data

(60) Division of application No. 11/585,652, filed on Oct. 24, 2006, now Pat. No. 7,870,680, which is a continuation-in-part of application No. 10/053,499, filed on Jan. 18, 2002, now Pat. No. 7,124,520.

(51) Int. Cl.
*A43B 13/38* (2006.01)

(52) U.S. Cl.
USPC ..... 36/43; 36/71

(58) Field of Classification Search
USPC ..... 36/43, 44, 29, 71, 141
See application file for complete search history.

(56) References Cited

U.S. PATENT DOCUMENTS 4,075,772 A 2/1978 Sicurella
4,281,467 A 8/1981 Anderie
4,345,387 A 8/1982 Daswick
4,521,979 A 6/1985 Blaser
4,674,203 A 6/1987 Goller
4,685,224 A 8/1987 Anger
4,843,741 A 7/1989 Yung-Mao
4,879,821 A 11/1989 Graham et al.
4,896,441 A 1/1990 Galasso
4,897,937 A 2/1990 Misevich et al.
5,233,767 A 8/1993 Kramer
5,469,639 A 11/1995 Sessa
5,509,218 A 4/1996 Arcan et al.
5,517,770 A 5/1996 Martin et al.
5,551,173 A 9/1996 Chambers
5,607,749 A 3/1997 Strumor
5,619,809 A 4/1997 Sessa
5,735,804 A 4/1998 Chan
5,749,111 A 5/1998 Pearce
5,853,844 A 12/1998 Wen
5,860,229 A 1/1999 Morgenstern
5,994,450 A 11/1999 Pearce
6,026,527 A 2/2000 Pearce
6,187,837 B1 2/2001 Pearce
6,598,321 B2 7/2003 Crane et al.
6,959,505 B2 * 11/2005 Poe ..... 36/43
7,124,520 B2 10/2006 Galbraith et al.
7,140,126 B2 11/2006 Crane et al.
7,870,680 B2 * 1/2011 Zona ..... 36/43

* cited by examiner

*Primary Examiner* — Marie Patterson
(74) *Attorney, Agent, or Firm* — Gordon & Rees LLP

(57) ABSTRACT

Support liners and cushions which include including a plurality of compressible protrusions. An arrangement is provided for interconnecting the compressible protrusions, the interconnecting arrangement being adapted to ensure strict compression of the compressible protrusions upon acceptance of a compressive force.

15 Claims, 10 Drawing Sheets

SUPPORT LINERS AND ARRANGEMENTS INCLUDING THE SAME

CROSS-REFERENCE TO RELATED U.S. APPLICATION

The present application is a continuation of U.S. application Ser. No. 11/585,652, filed Oct. 24, 2006, now U.S. Pat. No. 7,870,680, which is a continuation-in-part of U.S. application Ser. No. 10/053,499, filed Jan. 18, 2002, now U.S. Pat. No. 7,124,520, the contents of which are hereby incorporated by reference.

FIELD OF THE INVENTION

The present invention generally relates to insoles that are provided in or for various types of footwear to provide greater comfort and/or utility for the wearer for general uses or more specific uses (e.g. running, tennis, etc.). The present invention also generally relates to material that can be used for bodily support or comfort in other contexts.

BACKGROUND OF THE INVENTION

History has seen the development of numerous footwear products designed for imparting greater comfort and/or utility to a typical wearer via the provision of, for example, specially designed soles which may also have some aesthetic value given the design used. It has also been found, historically, that additional comfort and utility may be provided through the use of insoles, which may be provided in the footwear products at the outset or may be sold separately for being inserted into footwear products at a later time.

Footwear insoles may assume a variety of configurations and may use any of a wide variety of materials, and efforts are continually being made to improve upon any and all designs previously attempted. Footwear insoles may even be designed for aesthetic appeal as an adjunct to the aforementioned considerations, whether in the form of a particular textural pattern imparted to the insole, or of a given color scheme, or both.

The textural pattern found on the bottom side of a footwear insole, that is, on that side which disposed away from a wearer's foot and which interfaces with the inside of an actual footwear item, may have a significant impact on the degree of comfort experienced by the wearer and on various considerations relating to the overall utility of the footwear item in question.

U.S. Pat. No. 5,749,111 (Pearce) discloses a textural pattern employed in connection with a type of cushioning element that is known to have been employed in footwear insoles. Such a cushioning element presents what is described as a column buckling effect. Essentially, the material of a cushioning element may be so configured as to present "columns" of deformable material which, upon the application of a critical load which may, e.g., be provided by a protruberance on an object being cushioned, will cause the "columns" to "buckle" much as in the case of "column buckling" phenomena taken into consideration in basic structural engineering design. Though one who wears a footwear insole (or insert) utilizing this type of cushioning element does typically experience a cushioning effect, such a cushioning effect appears to be present at the expense of stability, since such a shoe insole is subject to undesirable degrees of movement.

Truform Manufacturing, Inc., of Athens, Tenn. presently manufactures a footwear insert ("Geo-Sole") that involves a textural pattern (on its lower side) that is markedly different from the "column buckling" phenomenon discussed above. FIG. 1 is a view of the underside of such an insert (100), in this case for the right foot. Here, a repeated pattern of protrusions is provided in which each protrusion (102) has a three-pronged cross-sectional shape and has a thickness that varies from a minimum at the outer periphery of the shape (highlighted at 103) to a maximum along three central ridges (highlighted at 104) which help define the overall three-pronged shape. Generally, each prong 108 of most protrusions is oriented towards an apex defined by two adjacent prongs of a neighboring protrusion. A commonly sized gap is generally present between the outer periphery of each protrusion and that of each neighboring protrusion. Though this insole overcomes the aforementioned disadvantages of a "column buckling" arrangement to some degree, it has been found that stability related to reduced movement of the insole is still somewhat elusive.

Outside of the context of footwear, attempts have long been made to provide bodily comfort and support in contexts where such advantages may be of particular need. For instance, seniors have often experienced great discomfort with seating not only in everyday contexts such as the home and other venues (such as movie theaters, stadia, public transportation, medical offices) where there is a need to sit down, but in dedicated mobility equipment such as wheelchairs and motorized scooters. Support and comfort has been found to be of particular importance in the context of mobility equipment at the very least because of the need to adequately protect and cushion a body in the event of a sudden mechanical impact (such as the mobility equipment going over a bump, running into another object or being hit by another object).

In view of the foregoing, a need has been recognized in connection with providing a footwear insole that overcomes the shortcomings and disadvantages experienced with conventional arrangements. Needs have also been recognized in connection with according improvements in bodily support and comfort to items other than footwear.

SUMMARY OF THE INVENTION

Broadly contemplated in accordance with at least one presently preferred embodiment of the present invention is a footwear insole including a plurality of compressible protrusions. An arrangement is provided for interconnecting the compressible protrusions, the interconnecting arrangement being adapted to ensure strict compression of the compressible protrusions upon acceptance of a compressive force.

In accordance with an embodiment of the present invention, the protrusions may present varying thicknesses of compressible material, wherein at least one thickness corresponds to a first stage of compression upon acceptance of a compressive force and at least one thickness corresponds to a second stage of compression upon acceptance of a compressive force, the second stage of compression initiating upon completion of the first stage of compression. The first stage of compression may correspond to a first spring force and the second stage of compression may corresponds to a second spring force, the second spring force including the first spring force and an augmenting spring force.

At least one thickness associated with the insole may correspond to a third stage of compression upon acceptance of a compressive force, the third stage of compression initiating upon completion of the second stage of compression. Also, the third stage of compression may correspond to a third compressive force, the third spring force including the second spring force and a second augmenting spring force.

The protrusions may comprise a first set of protrusions and a second set of protrusions, and the aforementioned interconnecting arrangement may comprise a base. In this case, the first set of protrusions may have the at least one thickness corresponding to the first stage of compression, the second set of protrusions may have the at least one thickness corresponding to the second stage of compression, and the base may have the at least one thickness corresponding to the third stage of compression.

Preferably, the insole comprises a forward impact region and a rearward impact region, each of the forward and rearward impact regions including a plurality of protrusions, the plurality of protrusions in the rearward impact region presenting generally greater thicknesses than corresponding protrusions in the forward impact region.

In accordance with at least one embodiment of the present invention, the aforementioned interconnecting arrangement may comprise a base and a plurality of interconnecting portions extending between the protrusions, with the interconnecting portions being disposed on the base. Here, the protrusions may have the at least one thickness corresponding to the first stage of compression, the interconnecting portions may have the at least one thickness corresponding to the second stage of compression and the base may have the at least one thickness corresponding to the third stage of compression. The protrusions may each include a plateau and a peripheral edge, wherein the at least one thickness corresponding to the first stage of compression may comprise varying thicknesses between the plateau and the peripheral edge. Forward and rearward impact regions of the insole may have a central area and a peripheral area, each of the forward and rearward impact regions including a plurality of the protrusions and, in at least one of the forward and rearward impact regions, a plurality of protrusions in the central area may be greater in areal extent than a plurality of the protrusions in the peripheral area.

In accordance with at least one embodiment of the present invention, a first group of protrusions may be adapted to maximally absorb a compressive force along a first primary force vector and a second group of protrusions may be adapted to maximally absorb a compressive force along a second primary force vector. Further, a third group of the protrusions may be adapted to maximally absorb a compressive force along a third primary force vector. The first primary force vector may be essentially parallel to a longitudinal axis of the insole, the second primary force vector may be oriented at an acute angle, and in a leftward and forward direction, with respect to the first primary force vector, and the third primary force vector may be oriented at an acute angle, and in a rightward and forward direction, with respect to the first primary force vector. In one refinement, the second primary force vector may oriented at an angle of between about 30 degrees and about 45 degrees, and in a leftward and forward direction, with respect to the first primary force vector. In another refinement, the third primary force vector may be oriented at an angle of between about 30 degrees and about 45 degrees, and in a rightward and forward direction, with respect to the first primary force vector. A forward impact region of the insole may comprise a plurality of the first group of protrusions, a plurality of the second group of protrusions and a plurality of the third group of protrusions.

In accordance with at least one embodiment of the present invention, an insole is formed from a gel material, which could be styrene-based or polyurethane-based. The gel material could preferably have a durometer measurement of between about 40 Shore OO and about 65 Shore OO, and most preferably about 55 Shore OO.

In accordance with at least one embodiment of the present invention, the protrusions may be formed from different materials with different durometer measurements.

Included in accordance with at least one embodiment of the present invention is an arch stiffener. A remainder of the insole could be formed from at least one material that is less stiff than the arch stiffener.

An insole in accordance with at least one embodiment of the present invention could be an element that is freely incorporable into footwear and freely removable therefrom. Though an insole could be sufficiently large as to accommodate both the heel and metatarsal areas of a foot, it could alternatively be sized to accommodate solely the heel area of a foot or solely the metatarsal area of a foot.

There is further broadly contemplated herein, in accordance with at least one presently preferred embodiment of the present invention, a support liner or dedicated cushion which includes material having features of the footwear insoles just described. Thus, a scooter or wheelchair seat bottom, seat back and/or armrests may be provided with an internal liner having features (including protrusions) similar to those provided in insoles as just described, or such a liner could be part of a portable cushion (e.g. with seat bottom and seat back portions attached to one another and that can folded atop one another) that can conveniently be carried to a location requiring sitting down (e.g., a wheelchair; scooter; chair in the home; stadium, theater or bus seating, etc.) and placed at such a location to provided greater support and comfort for the user. Such a portable cushion could alternatively include armrest portions which may or may not be attached to seat bottom and/or seat back portions.

In summary, the present invention provides, in accordance with at least one preferred embodiment, an insole for footwear, the insole comprising: a plurality of compressible protrusions; and means for interconnecting said compressible protrusions, the interconnecting means being adapted to ensure strict compression of said compressible protrusions upon acceptance of a compressive force.

Further, there is broadly contemplated herein, in accordance with at least one presently preferred embodiment of the present invention.

BRIEF DESCRIPTION OF THE DRAWINGS

The present invention and its presently preferred embodiments will be better understood by way of reference to the detailed disclosure herebelow and to the accompanying drawings, wherein.

DESCRIPTION OF THE PREFERRED EMBODIMENTS

Figure 1:
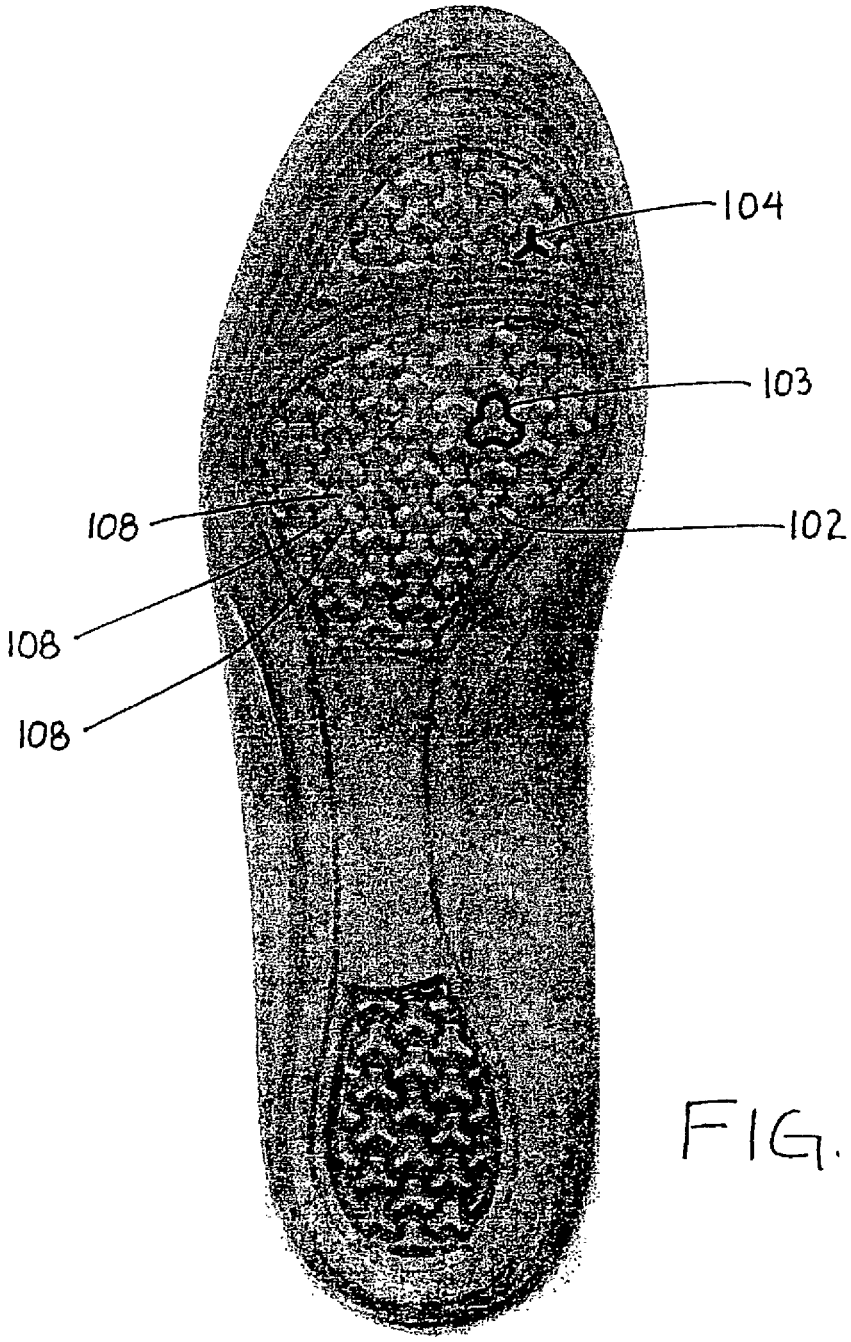
FIG. 1 is a view of the underside of a conventional right foot insole.
Figure 2:
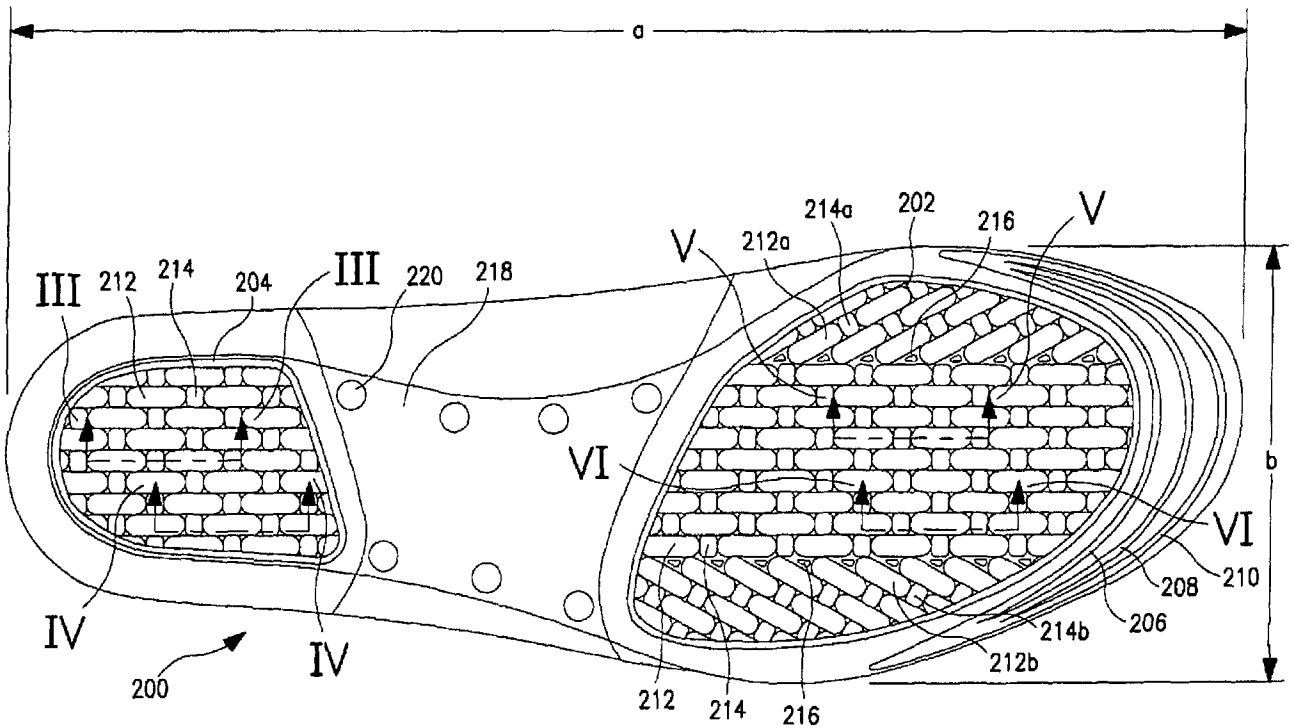
FIG. 2 is a view of the underside of a first insole embodiment (for a left foot)

FIG. 2 is a view of the underside of a first insole embodiment (for a left foot). As shown, insole 200 may preferably include a first circumscribing groove 202 which defines therewithin a forward impact region (i.e. corresponding to the ball and other forward areas, of a foot) and a second circumscribing groove 204 which defines therewithin a rearward impact region (i.e. corresponding generally to the heel strike area of a foot).

At the forward end of the insole 200 there may be a series of sizing ridges (or, alternatively, grooves) 206, 208 and 210 which will appropriately define where insole 200 may be cut in order to correspond to different shoe sizes. For instance, ridges 206, 208 and 210 may correspond to U.S. men's shoe sizes of 9, 10 and 11, respectively. It should be understood, however, that in the context of the present embodiment and of other embodiments disclosed or contemplated herein, any insole may also be manufactured and sized to appropriately match a footwear item of given size, such that sizing ridges (or grooves) would not be necessary.

The dimensions a and b shown in FIG. 2 may correspond to essentially any suitable dimensions appropriate for the insole 200 (for instance, about 11.75" and about 4.076", respectively).

Preferably, the forward impact region (defined within groove 202) may include a set of first protrusions 212, second protrusions 214 and third protrusions 216. In accordance with a presently preferred embodiment, first protrusions 212 may have a generally capsule-like cross-sectional shape, with opposing rounded ends and a rectilinear central section joining the rounded ends. Second protrusions 214, on the other hand, may preferably be generally rounded in shape and yet of considerably less length than first protrusions 212.

A "central" group of protrusions in the forward impact region will preferably be oriented such that the first protrusions 212 will lie essentially in parallel with respect to the forward-to-rearward dimension of the insole 200 and of the wearer's foot. Here, the first and second protrusions 212, 214 may be disposed in alternating fashion in rows that are parallel with respect to one another and adjacent one another. The rows are preferably staggered such that, for instance, a second protrusion 214 in one row is adjacent to a first protrusion 212 in a neighboring row.

Another, "right-hand" group of protrusions in the forward impact region, disposed towards the right side of insole 200 (and the wearer's foot) and towards the top in the drawing, will also preferably be provided in a similar pattern of adjacent, staggered rows of alternating first and second protrusions 212*a*, 214*a* (as discussed above). However, the rows (and, thus, the longitudinal dimension of the first protrusions 212*a*) will preferably lie at an angle with respect to the longitudinal dimension along with the rows of protrusions 212, 214, in the aforementioned "central" group. Such an angle may preferably be between about 30 degrees and 45 degrees, as such angles are believed to yield highly favorable results.

Yet another, "left-hand" group of protrusions in the forward impact region, disposed towards the left side of insole 200 (and the wearer's foot) and towards the bottom in the drawing, will also preferably be provided in a similar patter of adjacent, staggered rows of alternating first and second protrusions 212*b*, 214*b* (as discussed above). However, the rows (and, thus, the longitudinal dimension of the first protrusions 212*b*) will preferably lie at an angle with respect to the longitudinal dimension along with the rows of protrusions 212, 214, in the aforementioned "central" group. Again, such an angle may preferably be between about 30 degrees and 45 degrees, as such angles are believed to yield highly favorable results.

The aforementioned third set of protrusions 216 may each have a generally triangular cross-sectional shape (albeit, preferably, with rounded corners) and may be disposed in generally triangular gaps that are formed where one outermost row of protrusions 212, 214 in the "central" group intersects several rows of protrusions 212*a*, 214*a* in the "right-hand" group and where another outermost row of protrusions 212, 214 in the "central" group intersects several rows of protrusions 212*b*, 214*b* in the "left-hand" group Preferably, the rearward impact region (defined within groove 204) will include a set of first protrusions 212 and second protrusions 214 disposed and configured in much the same manner as the protrusions 212, 214 found in the aforementioned "central" group in the forward impact region.

In accordance with an embodiment of the present invention, the protrusions 212/214 (including 212*a*/214*a* and 212*b*/214*b*) help form a "three level" force absorbing medium that is believed to help impart greater comfort and utility to a user of insole 200. The three levels in question are better appreciated from FIGS. 3-7 but it should be understood that such an arrangement acts in a manner similar to a compound spring, whereby additional support is provided as each "level" is compressed to a point at which a new "level" is encountered and that augments the compressive force already being provided by the one or more previous "levels".

In accordance with an embodiment of the present invention, significant advantages are enjoyed in connection with the fact that all protrusions 212/214 (including 212*a*/214*a* and 212*b*/214*b*) are interconnected with one another at the bases of the protrusions. In this vein, it should be appreciated that such interconnection ensures that essentially no protrusion or group of protrusions will buckle under load (as in the previously mentioned "column buckling" phenomenon) and will only compress under load, resulting in a heightened perception of stability on the part of the wearer.

In accordance with an embodiment of the present invention, the differing orientations of the rows of protrusions in the aforementioned "central", "right-hand" and "left-hand" groups helps provide optimal force absorption (and thus greater comfort and utility for the wearer) when the primary force vectors associated with given loading conditions largely correspond to the lie of the rows of protrusions in the section in question of the forward impact region of insole 200. For instance, if the insole 200 is used in a shoe during a basketball game, it is likely that the wearer will experience moments of abrupt stopping, from a running pace, on the basketball court. Depending on the direction in which the wearer is running, the bulk of the impact force encountered upon stopping may be applied to either the left-hand, central, or right-hand part of the shoe. It will thus be appreciated that the protrusions 212*a*/214*a* in the "right-hand" group of the forward impact region of insole 200 will serve admirably to absorb an impact force resulting from an abrupt stop after the wearer has been running in a generally forward but right-hand direction and that the protrusions 212*b*/214*b* in the "left-hand" group of the forward impact region of insole 200 will serve admirably to absorb an impact force resulting from an abrupt stop after the wearer has been running in a generally forward but left-hand direction. Generally, it is believed that a heightened perception of comfort, stability and support is provided to the wearer not only during forward movement but also during lateral (including "diagonal") movements.

In contrast with the "column buckling" arrangements disclosed in U.S. Pat. No. 5,749,111, the protrusions 212/214 (including 212*a*/214*a* and 212*b*/214*b*) merely undergo compression and thus need not be so configured and designed as to assume a more complicated scheme of deformation in response to given loads. Again, essentially no protrusion or group of protrusions will buckle under load (as in the previously mentioned "column buckling" phenomenon) and will only compress under load, resulting in a heightened perception of comfort and stability on the part of the wearer. An enhanced cushioning effect is achieved via the features of compressibility and the "compound spring" effect associated with multiple levels.

Though the entirety of insole 200 may be made of the same (preferably gel) material, in accordance with an embodiment of the present invention, a portion 218 of the insole 200 may actually be configured as an "arch stiffener". In such an embodiment, a significant portion (218) of the insole 200 between the forward impact region (defined by groove 202) and the rearward impact region (defined by groove 204) may be made of a stiffer material, such as long-strand fiberglass plastic, or carbon fiber plastic. Mechanical fastening of this second, stiffer material to the primary gel material of the insole 200 may be accomplished via fastening points 220, where a recess in the stiffer material 218 may accommodate a portion of gel material that extends from the main body of insole 200 to the underside of the insole 200. These fastening points 220 can preferably be seven in number, sized and distributed as shown, or could be sized smaller and greater in number. An adhesive may also be used in place of, or along with, the fastening points 220 as needed or desired for providing a stronger degree of attachment.

Essentially, any of a very wide variety of materials may be employed for an insole 200 (and others discussed herein) in accordance with at least one embodiment of the present invention. There exist, e.g., numerous commercially available styrene or polyurethane-based gel materials well-suited for this purpose (such materials are recognized as having greater impact-absorbing properties in comparison with other materials, such as foams). Presently contemplated durometer measurements of such materials may preferably be in the range of about 40 Shore OO to about 65 Shore OO, and most preferably about 55 Shore OO (corresponding to 3 Shore A). Suitable gel materials are manufactured by the GLS Corporation of McHenry, Ill., and Teknor Apex/QST of Pawtucket, R.I. U.S. Pat. No. 5,994,450 (Pearce) also discloses gel materials that may be suitable.

In accordance with at least one embodiment of the present invention, multiple durometer measurements, associated with different portions of an insole, are also broadly contemplated. Thus, for example, the forward impact region (inside groove 204) in FIG. 2 might be made from a gel of a different durometer measurement than the rest of the insole, and the same holds true for the rearward impact region (inside groove 202) or any other part of the insole 200.

Figure 3:
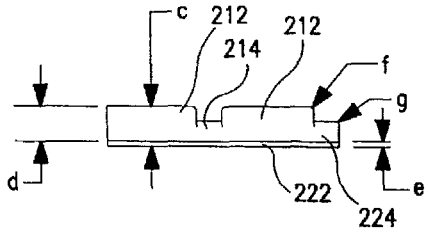
FIG. 3 is a side cross-sectional view taken along the line from FIG. 2.

FIG. 3 is a side cross-sectional view taken along the line from FIG. 2. As shown, a layer of cloth 222 is preferably provided on which protrusions 212/214 of the rearward impact region are mounted.

Protrusions 212/214 preferably all share a common base 224. Some sample dimensions could be: c (overall thickness), about 0.240 in.; d (thickness of a protrusion 212, including base 224), about 0.215 in.; e (thickness of cloth 222), about 0.025 in.; f (radius of curvature of the upper edge of a protrusion 212), 0.031 in.; and g (radius of curvature of the upper edge of a protrusion 214), 0.016 in.

Figure 4:
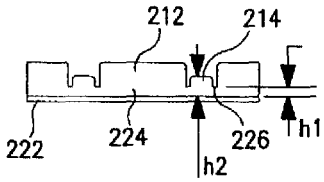
FIG. 4 is a side cross-sectional view taken along the line IV-IV from FIG. 2.

FIG. 4 is a side cross-sectional view taken along the line IV-IV from FIG. 2, involving a similar set of protrusions 212/214 as in FIG. 3. Indicated at 226 is a gap present between protrusions 212 and 214. For sample dimensions, the thickness h1 of protrusion 214 with respect to cloth 222 may be 0.125 in. while the thickness h2 of common base 224, may be about 0.063 in. Thus, the aforementioned "three level" effect arises from the differing thicknesses, with respect to cloth 222, provided at gaps 226, protrusions 214 and protrusions 212.

It should be understood that any of a wide range of possible dimensions may be chosen for the contemplated "three levels", provided that the "levels" differ sufficiently in height (or thickness) as to adequately provide the aforementioned "compound spring" effect. Though the dimensions shown in FIGS. 3-6 have been found to be quite admirably suited for this purpose, dimensions may also be chosen at more constant intervals. For instance, it is conceivable to provide common base 224 with a thickness of 0.125", protrusions 214 with a thickness of 0.250" and protrusions 212 with a thickness of 0.375".

Figure 5:
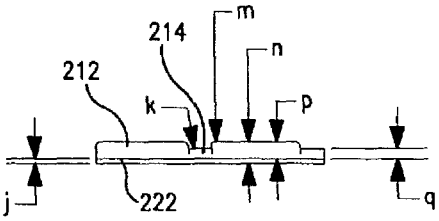
FIG. 5 is a side cross-sectional view taken along the line V-V from FIG. 2.

FIG. 5 is a side cross-sectional view taken along the line V-V from FIG. 2. As shown, cloth layer 222 is again provided on which protrusions 212/214 of the forward impact region are mounted. Preferably, these protrusions may be less thick than in the case of those in the rearward impact region, in view of the greater forces normally applied to one's heel. Again, protrusions 212/214 preferably share a common base 224. Some sample dimensions could be: n (overall thickness), about 0.240 in.; p (thickness of a protrusion 212, including base 224), about 0.105 in.; q (thickness of a protrusion 214, including base 224), about 0.065 in.; j (thickness of cloth 222), about 0.025 in.; m (radius of curvature of the upper edge of a protrusion 212), 0.031 in.; and k (radius of curvature of the upper edge of a protrusion 214), 0.016 in.

Figure 6:
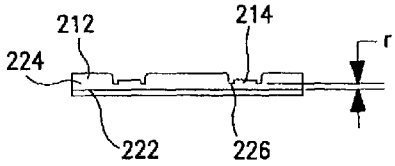
FIG. 6 is a side cross-sectional view taken along the line VI-VI from FIG. 2.

FIG. 6 is a side cross-sectional view taken along the line VI-VI from FIG. 2. Again, indicated at 226 is a gap present between protrusions 212 and 214. As a sample dimension, the thickness r of common base 224 may be about 0.040 in. Again, the "three-level" effect should be appreciated here as in the protrusions 212/214 of the rearward impact region.

At the forward end of the insole 200 there may be a series of sizing ridges 206, 208 and 210 which will appropriately define where insole 200 may be cut in order to correspond to different shoe sizes. For instance, ridges 206, 208 and 210 may correspond to U.S. men's shoe sizes of 9, 10 and 11, respectively.

Figure 7A:
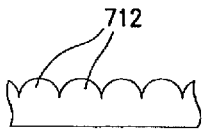
FIG. 7*a* is a side cross-sectional view taken along the line VII-VII from FIG. 7.
Figure 7:
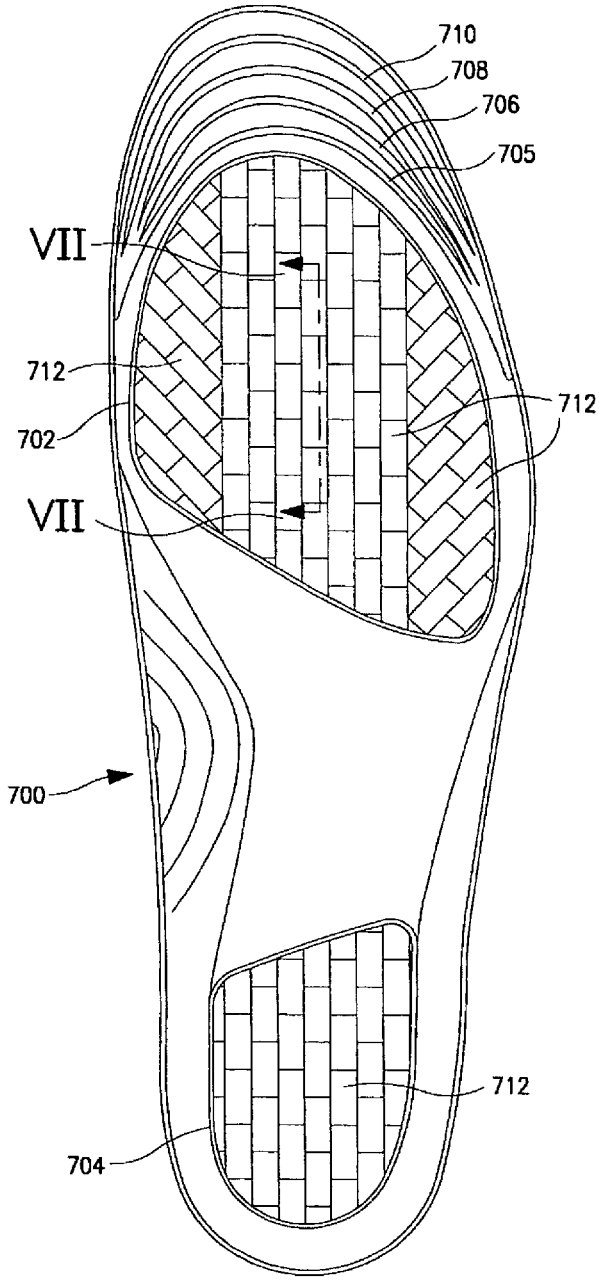
FIG. 7 is a view of the underside of a second insole embodiment (for a left foot)

FIG. 7 is a view of the underside of a second insole embodiment (for a left foot). As shown, insole 700 may preferably include a first circumscribing groove 702 which defines therewithin a forward impact region (i.e. corresponding to the ball and other forward areas of a foot) and a second circumscribing groove 704 which defines therewithin a rearward impact region (i.e. corresponding generally to the heel of a foot).

At the forward end of the insole 700 there may be a series of sizing ridges 705, 706, 708 and 710 which will appropriately define where insole 700 may be cut in order to correspond to different shoe sizes (e.g. corresponding to U.S. men's shoe sizes of 8, 9, 10 and 11, respectively).

In the embodiment shown in FIG. 7, a series of "half-barrel" protrusions 712 are preferably provided, each being of similar configuration and arrangement in rows in a manner not dissimilar to that shown in FIG. 2. Further, the feature of a common base, as discussed with respect to FIG. 2, is also preferably present here, thus providing the aforementioned advantages associated with interconnected bases.

FIG. 7*a* is a side cross-sectional view taken along the line VII-VII from FIG. 7, and shows a series of the "half-barrel" protrusions 712.

Figure 8:
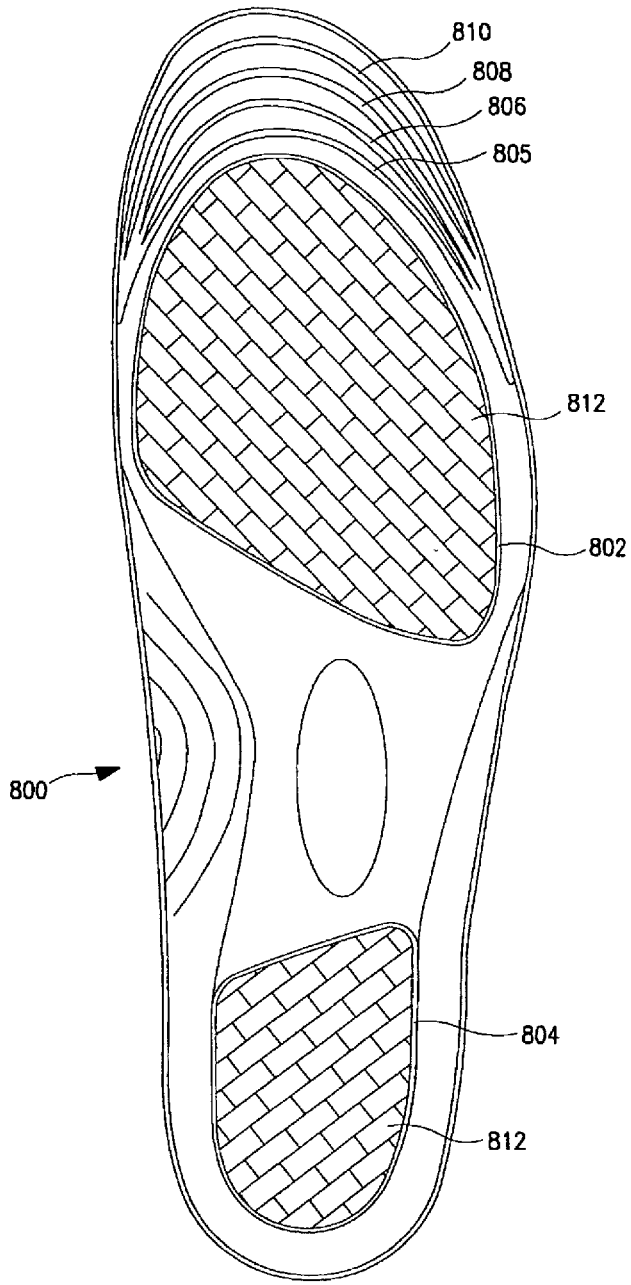
FIG. 8 is a view of the underside of a third insole embodiment (for a left foot)

FIG. 8 is a view of the underside of a third insole embodiment (for a left foot). As shown, insole 800 may preferably include a first circumscribing groove 802 which defines therewithin a forward impact region (i.e. corresponding to the ball and other forward areas of a foot) and a second circumscribing groove 804 which defines therewithin a rearward impact region (i.e. corresponding generally to the heel of a foot).

At the forward end of the insole 800 there may be a series of sizing ridges 805, 806, 808 and 810 which will appropriately define where insole 700 may be cut in order to correspond to different shoe sizes (e.g. corresponding to U.S. men's shoe sizes of 8, 9, 10 and 11, respectively).

In the embodiment shown in FIG. 8, a series of "half-barrel"-like (or even flatter) protrusions 812 are preferably provided, each being of similar configuration as those shown in FIG. 7 but oriented strictly in diagonal rows with respect to the longitudinal dimension of insole 800. Further, the feature of a common base, as discussed with respect to FIG. 2, is also preferably present here, thus providing the aforementioned advantages associated with islands and bases.

Figure 9:
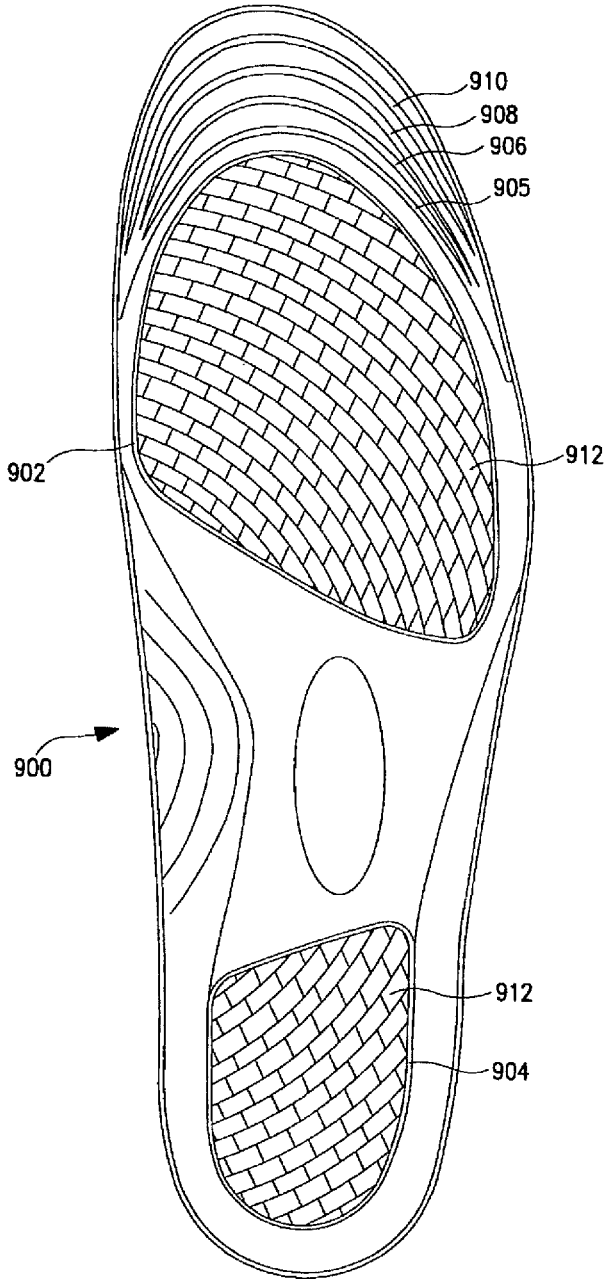
FIG. 9 is a view of the underside of a fourth insole embodiment (for a left foot)

FIG. 9 is a view of the underside of a fourth insole embodiment (for a left foot). As shown, insole 900 may preferably include a first circumscribing groove 902 which defines therewithin a forward impact region (i.e. corresponding to the ball and other forward areas of a foot) and a second circumscribing groove 904 which defines therewithin a rearward impact region (i.e. corresponding generally to the heel of a foot).

In the embodiment shown in FIG. 9, a series of "half-barrel"-like (or even flatter) protrusions 912 are preferably provided, each being of generally similar configuration as those shown in FIGS. 7 and 8 but oriented in rows that are curved, as shown, with respect to the longitudinal dimension of insole 900. Further, the feature of a common base, as discussed with respect to FIG. 2, is also preferably present here, thus providing the aforementioned advantages associated with islands and bases.

At the forward end of the insole 900 there may be a series of sizing ridges 905, 906, 908 and 910 which will appropriately define where insole 900 may be cut in order to correspond to different shoe sizes (e.g. corresponding to U.S. men's shoe sizes of 8, 9, 10 and 11, respectively).

Figure 10A:
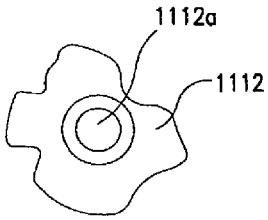
FIG. 10*a* is a view of an alternative version of an "island" for the embodiment of FIG. 10.
Figure 10B:
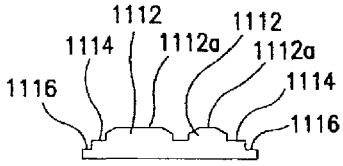
FIG. 10*b* is a side cross-sectional view of "islands" from FIG. 10.
Figure 10:
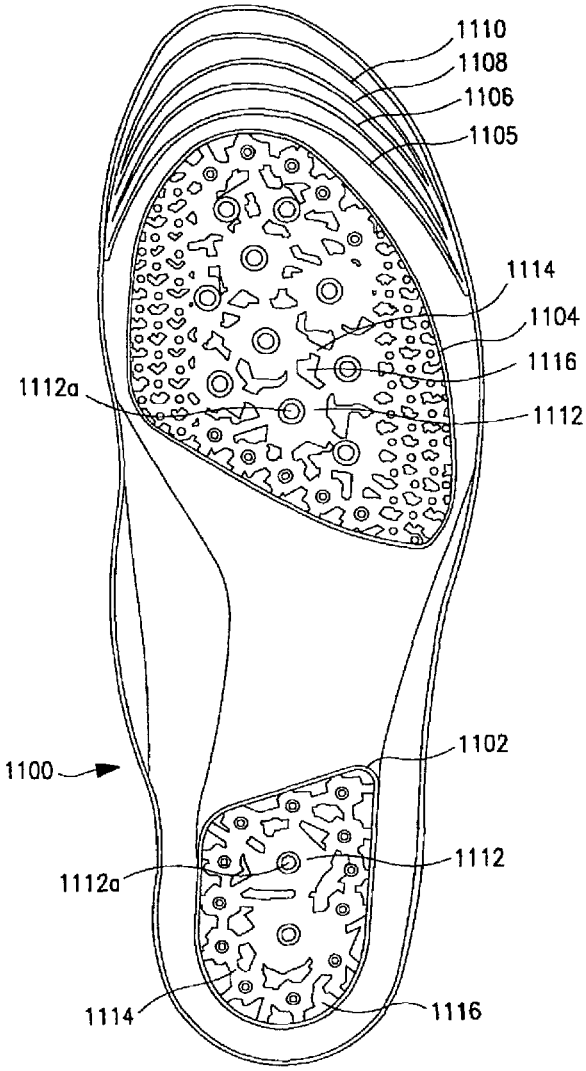
FIG. 10 is a view of the underside of a fifth insole embodiment (for a left foot)

FIG. 10 is a view of the underside of a fifth insole embodiment (for a left foot of a woman's shoe). As shown, insole 1100 may preferably include a first circumscribing groove 1102 which defines therewithin a forward impact region (i.e. corresponding to the ball and other forward areas of a foot) and a second circumscribing groove 1104 which defines therewithin a rearward impact region (i.e. corresponding generally to the heel of a foot).

At the forward end of the insole 1100 there may be a series of sizing ridges 1105, 1106, 1108 and 1110 which will appropriately define where insole 200 may be cut in order to correspond to different shoe sizes (e.g. corresponding to U.S. women's shoe sizes of 6-7, 8, 9 and 10, respectively).

Shown in FIG. 10, in each of a forward impact region (defined within groove 1104) and a rearward impact region (defined within groove 1102) are a number of protrusions in the form of "islands" 1112, each having an uppermost central crown area or plateau 1112*a*. The islands 1112 are interconnected with respect to one another via connecting portions 1114. Islands 1112 and connecting portions 1114 are integrally associated with a common base, and base regions 1116 are visible in the interstices between islands 1112 and connecting portions 1114.

As shown, islands 1112 may have a "jagged" outer periphery but may assume essentially any outer peripheral shape. Considerations of styling, inter alia, could determine such a shape. FIG. 10*a*, as such, shows an alternatively configured island 1112 that, instead of a jagged outer periphery, has one with more rounded corners.

FIG. 10*b* is a side cross-sectional view of islands 1112 and other components as contemplated in accordance with FIG. 10. As shown, base regions 1116, connecting portions 1114 and islands 1112 may present different thicknesses (or height dimensions) with respect to one another. Thus, a "three-level" configuration is again contemplated with the same advantages as discussed heretofore (e.g. in the manner of "islands" and "bases"), along with properties of interconnection and the aforementioned advantages associated therewith. It will also be noted that the islands 1112 need not necessarily be of constant thickness (or height dimension) such that, e.g., the plateau 1112*a* could present a maximum thickness dimension in the context of each island 1112, with this dimension decreasing to a minimum at the outer edge of each island 1112.

Preferably, islands 1112 may assume different two-dimensional extents (as shown in FIG. 10) in order to provide greater support for a wearer's foot at different places on the insole 1100. As shown, for instance, a "central" group of islands 1112 in the forward impact region (within groove 1104) may a be of markedly greater areal extent whereas islands 1112 in peripheral regions of the forward impact region may be smaller in areal extent. The same may hold true, as shown, in the context of the rearward impact region (within groove 1102).

Figure 11:
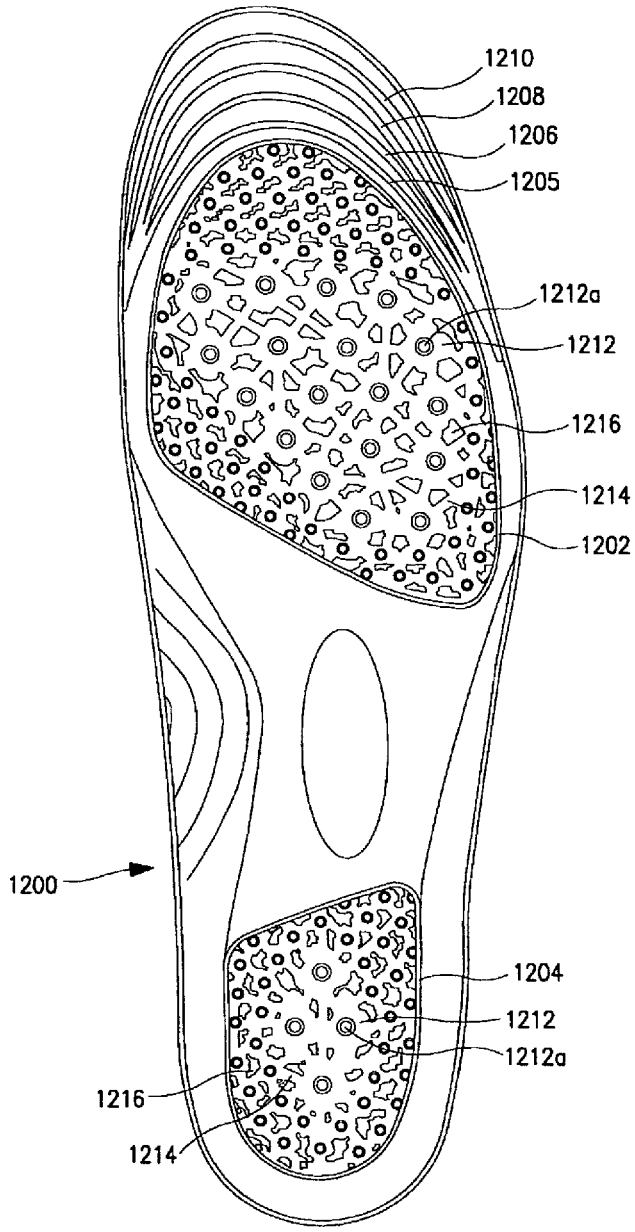
FIG. 11 is a view of the underside of a sixth insole embodiment (for a left foot)

FIG. 11 is a view of the underside of a sixth insole embodiment (for a left foot) and is similar to the embodiment shown in FIG. 10. In FIG. 11, similar components as those found in FIG. 10 bear reference numerals advanced by 100.

As shown, the insole 1200 in FIG. 11 has islands 1212 that are sized differently (in terms of their two-dimensional or areal extent) than the islands 1112 shown in FIG. 10. The configuration shown in FIG. 11, for instance, might be employed in order to provide "massaging" for the metatarsal and heel areas of a wearer's foot. A similar "three-level" arrangement as that shown in FIG. 10 is also preferably employed in the embodiment of FIG. 11, such that the most general aspects of the cross-sectional diagram provided by FIG. 10*b* are also relevant here.

Figure 12:
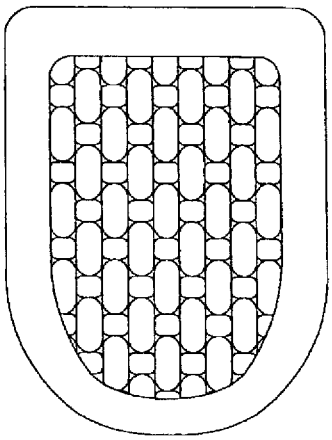
FIG. 12 is a view of the underside of a partial insole, sized to accommodate solely the heel area of a foot.
Figure 13:
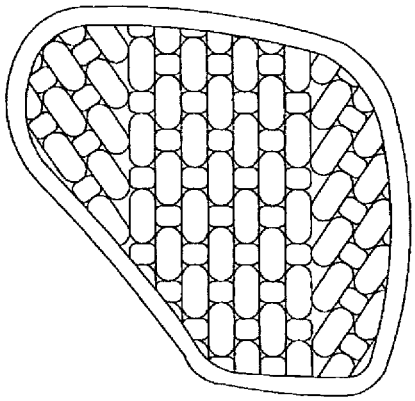
FIG. 13 is a view of the underside of a partial insole, sized to accommodate solely the metatarsal area of a foot.

FIG. 12 is a view of the underside of a partial insole, sized to accommodate solely the heel area of a foot. On the other hand, FIG. 13 is a view of the underside of a partial insole, sized to accommodate solely the metatarsal area (i.e. the ball area and adjacent areas) of a foot. Accordingly, it should be understood that an insole, in accordance with at least one embodiment of the present invention, may be in the form of a "partial insole" that is sized to accommodate solely one area or another of a foot.

There is further broadly contemplated herein, in accordance with at least one presently preferred embodiment of the present invention, a support liner or dedicated cushion which includes material having features of the footwear insoles just described. In a preferred embodiment of the present invention, the support liner or cushion would have features similar to those presented herein in connection with FIGS. 2-6. Preferably, there would be no groups of protrusions each oriented along different force vectors, but simply a repeated parallel pattern. The exemplary dimensions presented hereinabove could preferably be modified proportionately to result in a support liner or cushion with a maximum thickness of between about 1 and about 2 inches (but most preferably about 2 inches). It will be appreciated that a support liner or cushion with such dimensions will not present a great deal of bulk, as might be in the case of a cushion or support liner with a more unitary or monolithic cross-section.

Again, a scooter or wheelchair seat, seat back and/or armrests may be provided with an internal liner having features (including protrusions) similar to those provided in insoles as just described, or such a liner could be part of a portable cushion (e.g. with seat bottom and seat back portions attached to one another and that can folded atop one another) that can conveniently be carried to a location requiring sitting down (e.g., a wheelchair; scooter; chair in the home; stadium, theater or bus seating, etc.) and placed at such a location to provided greater support and comfort for the user. Such a portable cushion could alternatively include armrest portions which may or may not be attached to seat bottom and/or seat back portions.

It should be understood that the insoles described and/or contemplated herein may be in the form of inserts that are initially separate from footwear and that can then be inserted into footwear for a wearer's use or could, alternatively, be in the form of elements that are already integrated into footwear items prior to such footwear items being sold. Such integrated insoles could conceivably be freely removable from the footwear or could be firmly affixed to the footwear such that they are not freely removable.

In the context of all embodiments discussed or contemplated herein, it should be understood that numerous variations are conceivable without departing from the spirit or scope of the present invention. For instance, it is conceivable to employ a "four-level", "five-level" or "two-level" arrangement, or any other multiple-level arrangement, instead of a "three-level" arrangement, with a common feature being the "compound spring" behavior discussed heretofore. Further, materials other than those discussed heretofore can be used for forming an insole in accordance with at least one embodiment of the present invention. For example, a foam-type material may be used instead of a gel-type material. Such a foam-type material could, e.g., be in the form of a urethane-type foam, such as those manufactured by the Bayer Corporation of Pittsburgh, Pa.

If not otherwise stated herein, it may be assumed that all components and/or processes described heretofore may, if appropriate, be considered to be interchangeable with similar components and/or processes disclosed elsewhere in the specification, unless an express indication is made to the contrary.

If not otherwise stated herein, any and all patents, patent publications, articles and other printed publications discussed or mentioned herein are hereby incorporated by reference as if set forth in their entirety herein.

It should be appreciated that the apparatus and method of the present invention may be configured and conducted as appropriate for any context at hand. The embodiments described above are to be considered in all respects only as illustrative and not restrictive. All changes which come within the meaning and range of equivalency of the claims are to be embraced within their scope.

What is claimed is:

1. A support liner comprising:

a compressible base having a base surface;

a plurality substantially parallel rows of adjacent alternating first compressible protrusions and second compressible protrusions protruding in a direction away from the compressible base;

said first compressible protrusions each having a first longitudinal dimension and a first transverse dimension substantially perpendicular with respect to the first longitudinal dimension, the first longitudinal dimension being greater than the first transverse dimension;

said second compressible protrusions each having a second longitudinal dimension and a second transverse dimension substantially perpendicular with respect to the second longitudinal dimension, wherein the second longitudinal dimension is substantially parallel to the first transverse dimension;

wherein bases of adjacent first compressible protrusions and second compressible protrusions in a row are interconnected with the compressible base such that the compressible base forms a common base portion for the first compressible protrusions and the second compressible protrusions; and wherein the plurality of substantially parallel adjacent rows are staggered such that the second longitudinal dimension in one row is not coincident with another second longitudinal dimension in an adjacent row.

2. The support liner according to claim 1, wherein the first compressible protrusions, second compressible protrusions and compressible base form a single piece configured to be compressible and prevent column buckling of the first and second compressible protrusions.

3. The support liner according to claim 1, wherein the first compressible protrusions protrude from the base surface of the compressible base a height greater than a height of the second compressible protrusions.

4. The support liner according to claim 1, wherein said second longitudinal dimension is substantially similar in length to said first transverse dimension.

5. The support liner according to claim 1, wherein said protrusions are oriented to protrude away from a user's body.

6. The support liner according to claim 1, wherein the support liner is formed from a gel material.

7. The support liner according to claim 6, wherein the gel material is styrene-based.

8. The support liner according to claim 6, wherein the gel material is polyurethane-based.

9. The support liner according to claim 1, wherein the support liner is formed from foam.

10. The support liner according to claim 1, wherein the first and second compressible protrusions are formed from different materials with different durometer measurements.

11. The support liner according to claim 1, further comprising a plurality of third compressible protrusions positioned adjacent at least one of said first compressible protrusion and said second compressible protrusion.

12. The support liner according to claim 11, wherein at least one third compressible protrusion has a first angular dimension substantially parallel to said first longitudinal dimension.

13. The support liner according to claim 12, wherein at least one third compressible protrusion has a second angular dimension oriented at an acute angle with respect to the first angular dimension, and a third angular dimension oriented at an acute angle with respect to the first angular dimension wherein said second angular dimension and said third angular dimension are not parallel to one another.

14. The support liner according to claim 11, wherein the first compressible protrusions protrude from the base surface of the compressible base a height greater than a height of the third compressible protrusions.

15. The support liner according to claim 1, wherein the second longitudinal dimension is greater than the second transverse dimension.

* * * * *